US008104996B2

(12) United States Patent
Goebel et al.

(10) Patent No.: US 8,104,996 B2
(45) Date of Patent: Jan. 31, 2012

(54) TWO-SHELL STRUCTURAL SYSTEM FOR CONSTRUCTING PLANTABLE STEEP EMBANKMENTS FORMED FROM SEVERAL LAYERS

(75) Inventors: Claus Goebel, Dresden (DE); Klaus Lieberenz, Dresden (DE); Dietmar Adams, Dresden (DE); Steffen Grossmann, Dresden (DE)

(73) Assignee: Fraenkische Rohrwerke Gebr. Kirchner GmbH & Co. KG, Bavaria (DE)

( * ) Notice: Subject to any disclaimer, the term of this patent is extended or adjusted under 35 U.S.C. 154(b) by 0 days.

(21) Appl. No.: 12/950,903

(22) Filed: Nov. 19, 2010

(65) Prior Publication Data

US 2011/0070036 A1 Mar. 24, 2011

Related U.S. Application Data

(63) Continuation of application No. PCT/DE2009/000510, filed on Apr. 14, 2009.

(30) Foreign Application Priority Data

May 20, 2008 (DE) ..... 10 2008 024 459

(51) Int. Cl.
*E02D 5/20* (2006.01)

(52) U.S. Cl. ..... 405/284; 405/282

(58) Field of Classification Search ..... 405/262, 405/272, 284, 287.1, 302.4
See application file for complete search history.

(56) References Cited

U.S. PATENT DOCUMENTS

| | | | | |
|---|---|---|---|---|
| 4,619,560 | A * | 10/1986 | Crinnion et al. | 405/284 |
| 4,923,339 | A | 5/1990 | Smith | |
| 5,030,035 | A | 7/1991 | Babcock | |
| 5,370,480 | A | 12/1994 | Quaney | |
| 6,539,684 | B1 | 4/2003 | Graham | |
| 2003/0012608 | A1 * | 1/2003 | Race | 405/284 |
| 2006/0291962 | A1 | 12/2006 | Ferraiolo | |
| 2007/0036616 | A1 * | 2/2007 | Knudson et al. | 405/284 |

FOREIGN PATENT DOCUMENTS

| | | | |
|---|---|---|---|
| DE | 29921981 | U1 | 3/2000 |
| DE | 10004035351 | A1 | 4/2005 |
| DE | 102004014539 | A1 | 10/2005 |
| DE | 202006017056 | U1 | 3/2007 |

* cited by examiner

*Primary Examiner* — David Bagnell
*Assistant Examiner* — Benjamin Fiorello
(74) *Attorney, Agent, or Firm* — Patricia M. Mathers

(57) ABSTRACT

The invention relates to a two-shell structural unit and system of attaching the units to form an outer layer in the construction of a steep embankment formed from several layers, this outer layer being suitable for greening. The structural unit is formed by a front element, a spacer element, and a rear-wall element. The front and rear-wall elements have a flexurally rigid lattice structure. The rear-wall element is a planar element that is either a flat element or has a shape defined by a polygonal curve. The spacer element has a stepped form on at least one side and has mounts for frictional joints with geosynthetics. Connector pieces permit positive and frictional joining of the elements of the unit. The structural unit is intended for use as an independent support system to continuously resist horizontal loads exerted by a backfilled embankment.

17 Claims, 4 Drawing Sheets

TWO-SHELL STRUCTURAL SYSTEM FOR CONSTRUCTING PLANTABLE STEEP EMBANKMENTS FORMED FROM SEVERAL LAYERS

This application is a continuation of PCT/DE2009/000510, filed 14 Apr. 2009, and claims priority from foreign application DE 10 2008 024 459.7, filed 20 May 2008, which is incorporated by reference herein in its entirety.

BACKGROUND INFORMATION

1. Field of the Invention

The invention relates to a construction method for synthetic-reinforced earthworks. More particularly, the inventions relates to a system of constructing a steep embankment that is suitable for greening.

2. Description of the Prior Art

Geosynthetic-reinforced retaining structures and steep embankments are composite structures that are constructed from fill, reinforcements, and an outer skin. Shear-resistant, well-graded and compactable gravel sand is used as the fill. The reinforcements are embedded in the fill and typically comprise high-tensile-strength geosynthetics, such as, primarily, geogrids, textiles, and composites. The so-called outer skin is applied to the air side of the retaining structure to complete the structure. This composite structure of fill and reinforcements is the actual support system that guarantees the structural stability of the retaining structure. The outer skin is a protective system that serves to protect the support system from external influences and thereby ensures the long-term stability of the overall structure.

Prior art DE 10 2004 014 539 A1 discloses a recent solution, namely a system for the erection of retaining structures and steep embankments suitable for greening. The system comprises pad support walls that bear and dissipate static and/or dynamic loads. These pad walls are constructed with high-tensile-strength geosynthetic reinforcements embedded in a compacted fill. A separate, three-dimensionally structured outer skin, filled with non-compacted soils or materials capable of supporting greening or plant growth, is used during erection of the system as a temporary abutment for the geosynthetic reinforcements. This outer skin absorbs the pressure that arises when the individual fill layers are compacted and provides lasting protection for the pad walls. The outer skin comprises a multitude of segments that include unilaterally, vertically concave rear-wall elements and exchangeable front elements. The round bulges of the pad walls formed by the geosynthetics and the compacted fill butt up against the curved rear-wall segments. At least two spacers or spacer elements, to which the front and rear-wall elements are affixed, and which are arranged spaced parallel from each other on the front element, are used. The spacer elements are, in turn, mounted in profiles, constructed preferably as U-rails, that are anchored in the underlying pad by soil nailing. This structure forms box-like cavities, into which soils suitable for greening or other materials may be filled.

All prefabricated elements of the outer skin are joined by way of a plug-in or snap-fit connector system, whereby the use of adapter pieces between the front elements and the spacer elements enables the construction of an outer skin that has different steepness angles and curvatures.

The segments of the outer skin correspond in their vertical dimensions to the thickness of the layers of fill to be introduced and compacted. The outer skin is thus constructed in layer form. The segments of the outer skin are preferably 40 cm high. The layers of the outer skin are usually offset to each other in a step-like arrangement.

The front element is constructed as a flexurally rigid, three-dimensional lattice structure which may incorporate a fixed greening structure. It is intended that the front element and likewise the spacers be made of a synthetic material which implies a proportion of renewable raw materials.

The side of the spacers where the rear-wall elements are affixed is curved concavely to correspond to the curvature of the rear-wall elements; the side where the front elements are affixed has an angle of inclination between 55 and 70 degrees. The rear-wall elements are preferably constructed of a biodegradable material or natural fibers.

The special form of the rear wall of the outer skin achieves significant reduction in the magnitude of vertical and horizontal changes in the form of the support system, due to improved force flow in the geosynthetic reinforcements. In addition to satisfying the requirements with regard to the durability of such a structure, in other words frost and UV resistance, as well as resistance to damaging external influences, the conditions for greening are significantly improved. The fact that fill and cultivation soil are strictly separated, enabling the latter to be introduced loosely, also improves greening. Finally, the segments of the outer skin permit variable structuring of the segments with respect to inclination, height and contour, whereby it is possible to replace them in the case of damage, without impairing the structural stability of the support system.

Further aspects of the prior art are presented in detail in DE 10 2004 014 539 A1.

A disadvantage of solution described above is that the concavely formed rear wall of the system entails considerable manufacturing effort, namely complex tools, and is thus relatively cost-intensive. In addition, a system of this complexity is not necessary in many of the situations which call for retaining structures and steep embankments suitable for greening. Simplifying the design and the manufacturing of the element is thus advantageous. The large amount of geosynthetics required, even for steep embankments of low height and inclination, calls for a new solution.

What is needed therefore is a structural system for the erection of steep embankments that reduces manufacturing costs. What is further needed is such a system that is capable of achieving complex shapes, yet quickly and easily assemblable. What is yet further needed is such a system that reduces the use of geosynthetics.

BRIEF SUMMARY OF THE INVENTION

It is an object of the present invention to develop a structural system for the construction of steep embankments, whereby the system is economical in its manufacture. It is a further object of the invention to provide a system that is capable of achieving a complex structure that is applicable for the whole market spectrum of retaining walls and steep embankments that are suitable for greening. It is a yet further object of the invention to reduce the amount of geosynthetics that are needed in such a system.

The objects of the present invention are achieved by providing a two-shell structural system for the erection of a steep embankment that is suitable for greening. The two-shell structural system is made up of one or more structural units, each unit comprising a rear-wall element, a front element, and a spacer element that spaces the front element a distance from the rear-wall element. The three types of elements may be constructed of geosynthetic materials. The front element has a flexurally rigid three-dimensional lattice structure. The rear-wall element is permanently flexurally rigid and has a shape that extends in the vertical direction with straight lines, in other words, extends upward in a straight line or in a polygonal curve comprising straight line segments. The spacer element is capable of resisting pressure and has a stepped face that is an upper face when the element is assembled in the structural system. The two-shell structural system according to the invention allows a steep embankment to be constructed to the desired size and inclination by stacking multiple structural units together in the horizontal and vertical directions. Each two-shell structural unit used is joined by way of a frictional joint with geosynthetics laid horizontally over the top of the two-shell structural unit. Selectively offsetting one unit on the face of an underlying unit enables great variability in the construction of a steep embankment of a desired steepness and angle, and also enables the construction of a plurality of berms of equal or of different widths on the face of the embankment.

Connectors on the spacer element allow the rear-wall element and the front element to be fastened to the spacer element to form a unit. Mounts, which may also be constructed of geosynthetic materials, are arranged in the lower area of the spacer elements. It is particularly advantageous to fix the mounts on an anchor, such as a load-distributing rail. The connectors for adjoining the various elements may be provided at the top and bottom of the spacer element. Preferably, the connectors are detachable snap-fit clips.

The two-shell structural system described above may be used as an independent support system to continuously absorb horizontal pressure loads exerted by the backfilling in the embankment.

The two-shell structural system or outer skin of a retaining system for a steep embankment may be combined with geosynthetics in a differentiated manner in accordance with the selected use. It is thus possible to erect steep embankments of all kinds, with or without geosynthetics, whereby it is possible to construct a steep embankment formed from several layers and suitable for greening, in accordance with practical application parameters, such as embankment height, embankment inclination, static and dynamic loads, and suitable for use in different fields of application in civil engineering.

The covering and greening of a steep embankment can thus be achieved, by means of an offset stack of outer skin elements according to the invention, without a statically effective reinforcement with geogrids. Similarly, different forms of retaining structures may be constructed.

The components of the two-shell structural system may be prefabricated. Use of an outer layer or two-shell structural system according to the invention and the high degree of pre-fabrication of the components that is feasible, makes the implementation of the two-shell structural system especially expedient in situations in which retaining structures and steep embankments are to be erected swiftly and precisely, and at the same time with reduced environmental impact and with natural integration.

BRIEF DESCRIPTION OF THE DRAWINGS

The present invention is described with reference to the accompanying drawings. In the drawings, like reference numbers indicate identical or functionally similar elements. The drawings are not drawn to scale.

DETAILED DESCRIPTION OF THE INVENTION

The present invention will now be described more fully in detail with reference to the accompanying drawings, in which the preferred embodiments of the invention are shown. This invention should not, however, be construed as limited to the embodiments set forth herein; rather, they are provided so that this disclosure will be complete and will fully convey the scope of the invention to those skilled in the art.

Figure 1:
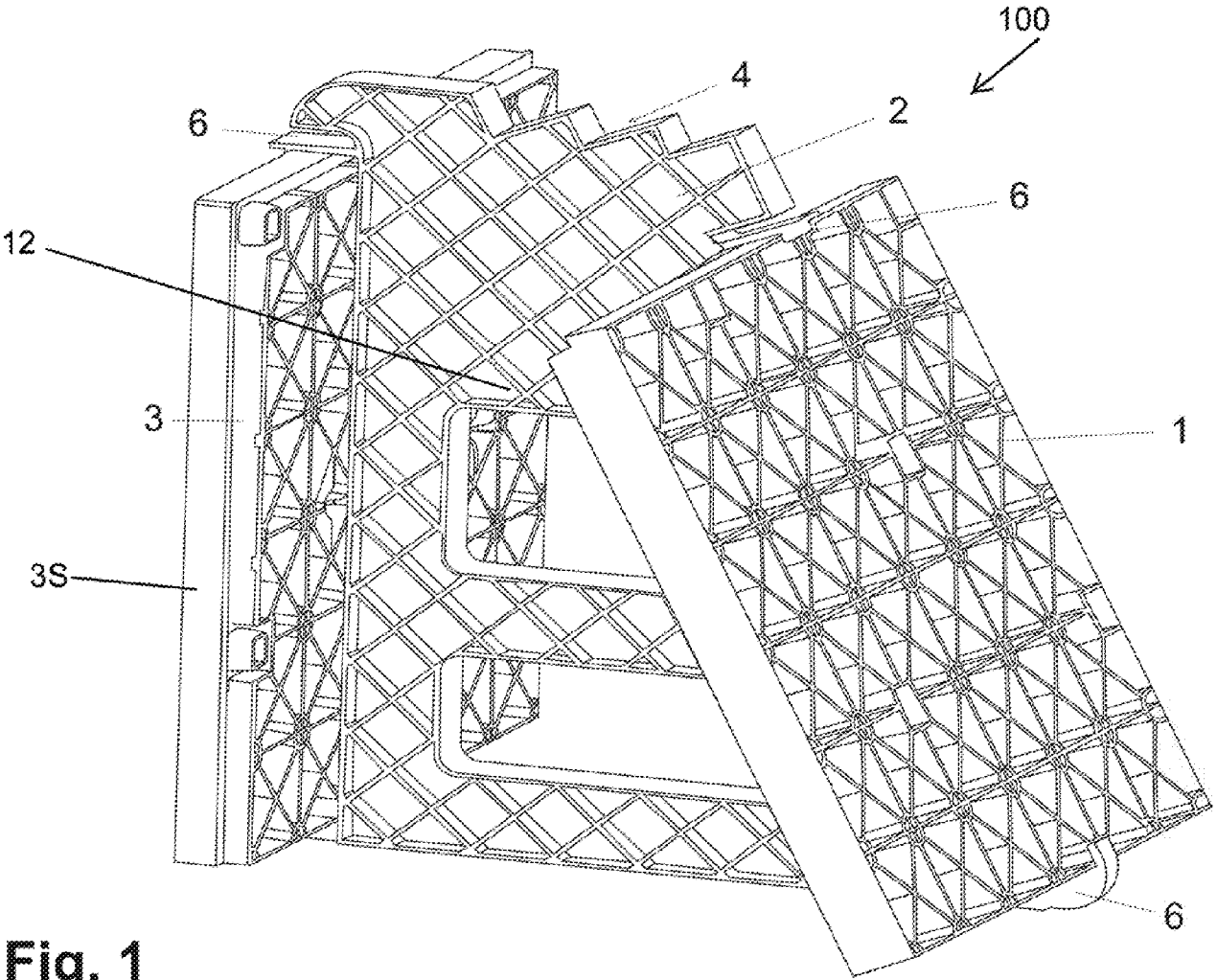
FIG. 1 is a perspective view of a first embodiment of the two-shell structural unit according to the invention, showing a front, a rear-wall, and a spacer element snapped together.

FIG. 1 illustrates a two-shell structural unit 100 according to the invention, for use in constructing an outer layer of a steep embankment, the outer layer being suitable for greening. The two-shell structural unit 100 comprises a front element 1, a spacer element 2, and a rear wall element 3. In this embodiment, the rear wall element 3 is generally constructed as a flat element. For example, the rear-wall element has a front face that faces toward the front element and side faces that are orthogonal to the front face. Looking at a side face 3S of the rear-wall element 3, one can see that the element extends in the vertical direction in a straight line. Connectors 6 are used to fasten the front element 1 and the rear-wall element 3 to the spacer element 2. The spacer element 2 provides a cavity 12 between the front element 1 and the rear-wall element 3 that may then be filled with non-compacted soil that is suitable for holding and nourishing plant growth for greening of an embankment, or with other materials, such as stones. Although many types of fasteners may be suitable for fastening the elements together, fasteners that provide a friction fit or a snap fit with the respective elements 1, 2, 3 provide a desired ease and versatility in assembling the two-shell structural unit 100. In the embodiment shown, the connectors 6 are integrally formed as part of the spacer element 2 and provide a friction fit with the respective elements 1 and 3.

The spacer element 2 displays a stepped form or notches 4 on its upper face. The spacer element 2 is constructed to withstand the horizontal pressure exerted by a backfilled embankment. The stepped form 4 provides a series of inclinations along the upper face of the spacer element 2 that may be selectively used to build up an embankment structure 1000 of a desired steepness and angle. The stepped form 4 also allows the construction of a plurality of berms of equal or of different widths. An embankment structure 1000 according to the invention is discussed below in conjunction with FIGS. 3-5.

Figure 2:
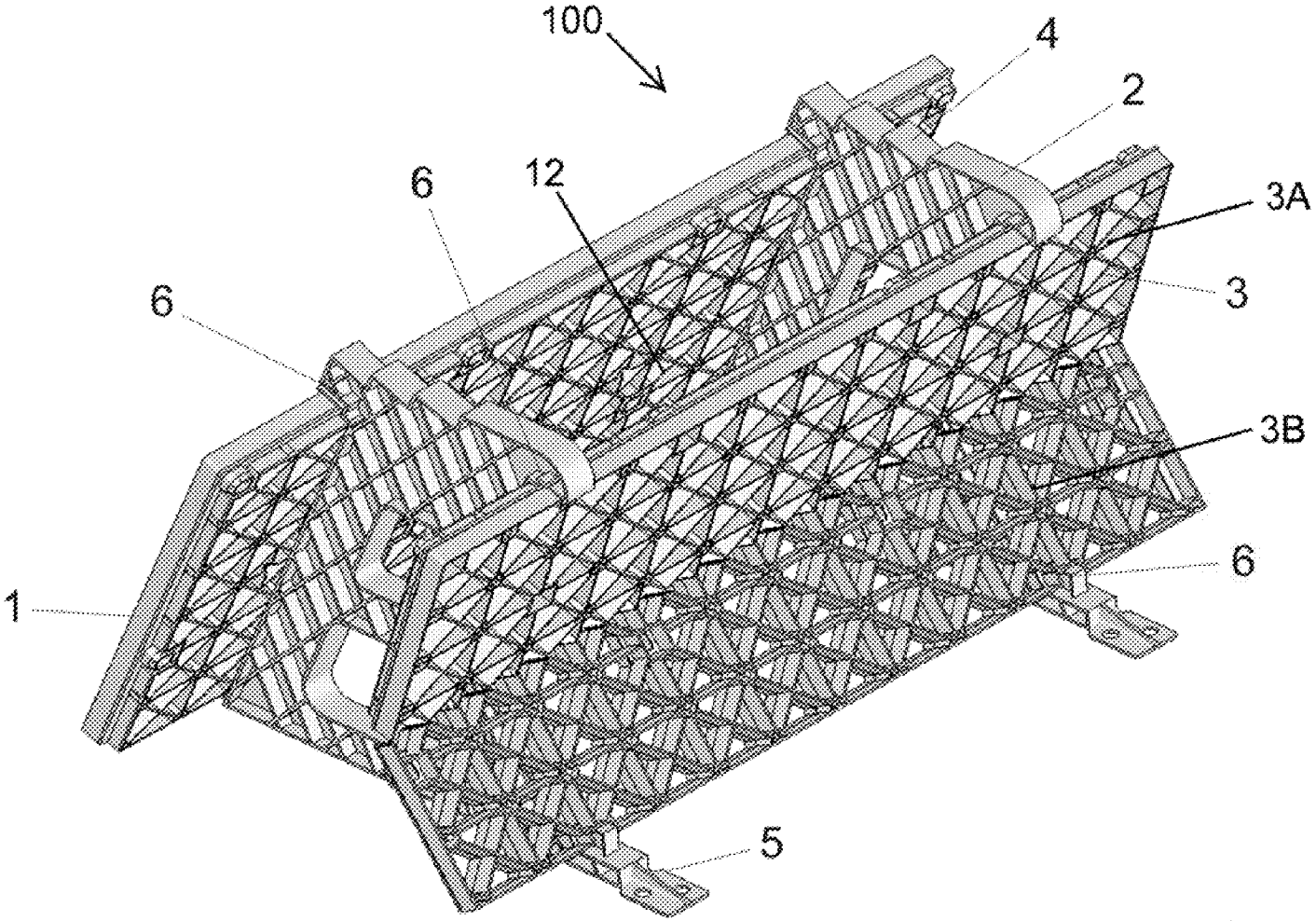
FIG. 2 is a perspective view of a second embodiment of the structural unit.

FIG. 2 shows the two-shell structural unit 100 that includes the front element 1, the rear-wall element 3, and two spacer elements 2, all assembled together to form a unit having a generally rectangular shape. This particular embodiment of the rear-wall element 3 has a contour that is a polygonal curve formed by two flat portions 3A and 3B.

FIG. 2 also illustrates a mount 5 for securing the spacer element 2 to the embankment. Ideally, the mount 5 is a load-distributing device, such as a flexurally rigid, U-shaped rail that has a length that is a multiple of its cross-section, although other suitable devices may also be used. A method conventionally known as soil nailing is used to fasten the mount 5 to the ground. In the embodiment shown in FIG. 2, the mount 5 is a flat plate with holes for receiving soil nails. The lower end of the spacer 2 also includes connectors 6 as described above, for fastening the rear-wall element 3 to the spacer 2.

The three elements 1, 2, 3 are constructed of geosynthetic materials and have an open lattice structure, so as to allow soil and fill to anchor the elements in place when the two-shell structural system 100 is installed in an embankment. The front element 1 and rear-wall element 3 are flexurally rigid.

Figure 3:
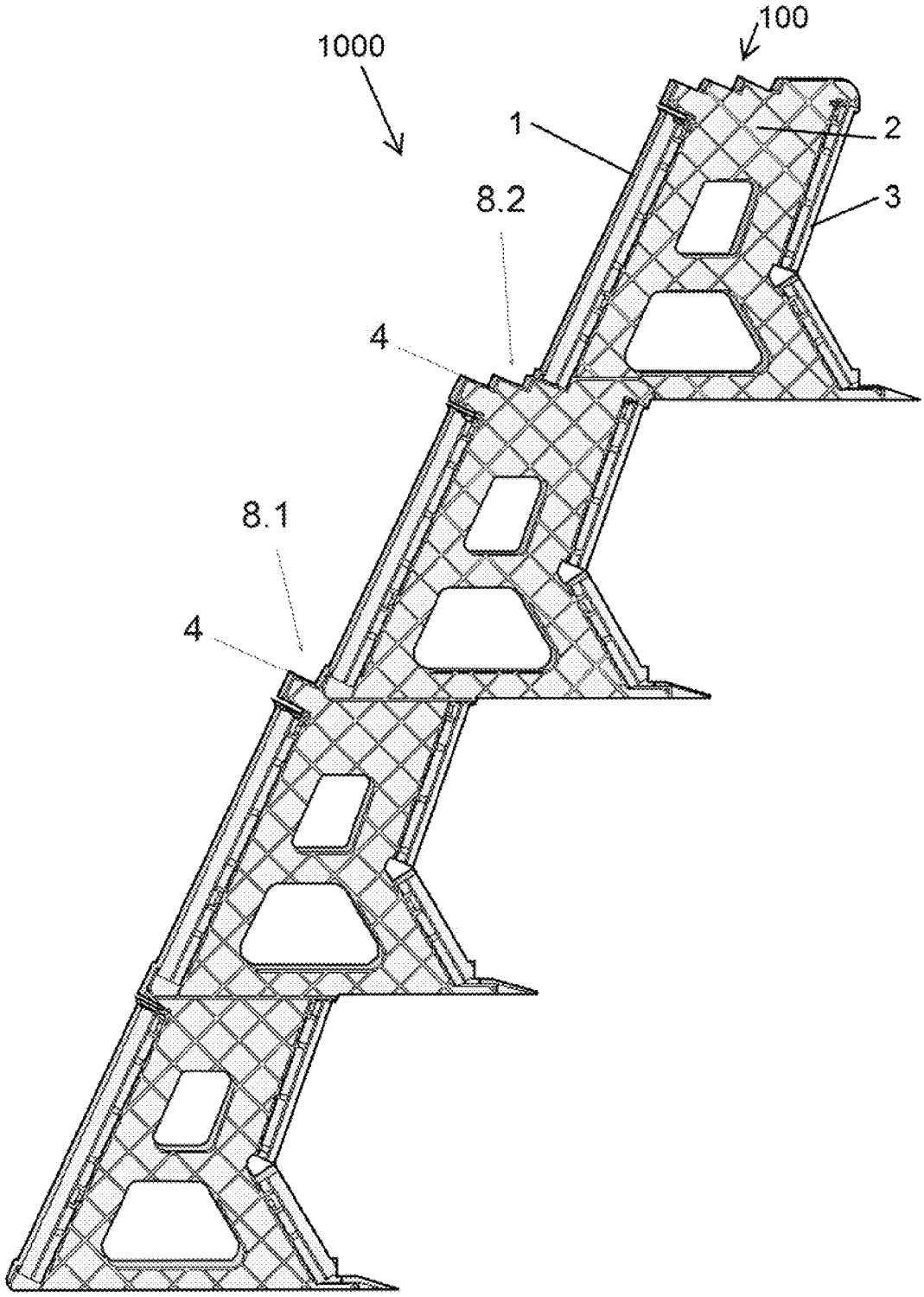
FIG. 3 is a side elevational view of a two-shell structural system according to the invention, showing multiple two-shell structural units stacked together to create a steep embankment of a particular height and inclination.
Figure 4:
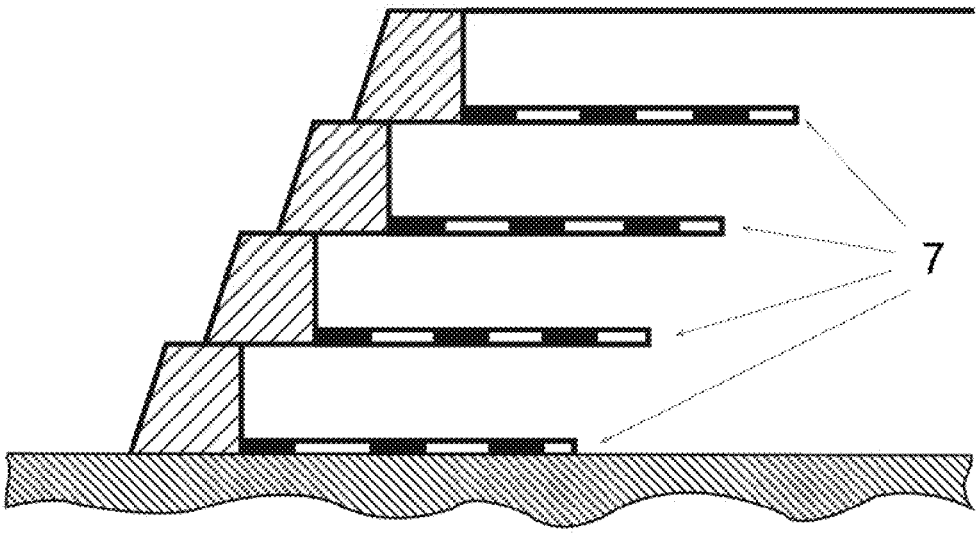
FIG. 4 is a schematic illustration of a cross-section of a steep embankment, erected with the two-shell structural system according to the invention, and showing a frictional joint provided by geosynthetics between each two stacked units.
Figure 5:
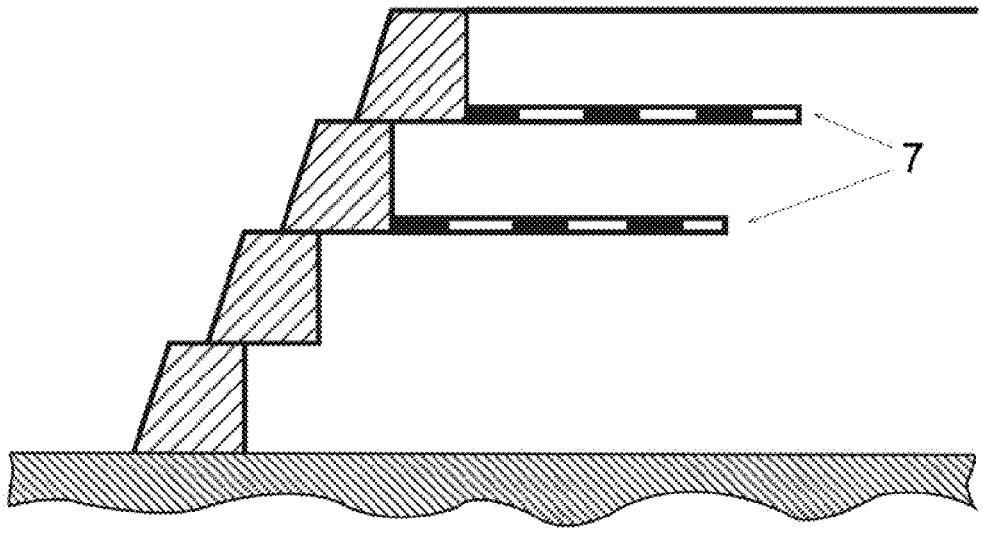
FIG. 5 is a schematic illustration of a cross-section of a steep embankment, erected with the two-shell structural system according to the invention, and showing a frictional joint provided by geosynthetics, selectively placed between several stacked units.

FIGS. 3-5 illustrate a two-shell structural system 1000, also referred to as an outer skin, according to the invention. FIG. 3 is a side elevational view of the outer skin of a steep embankment that is constructed by stacking four two-shell structural units 100 to achieve an embankment that has a particular height, inclination, and berm width. The spacer elements 2 of the respective units 100 are joined to each other by means of a frictional joint provided by geosynthetics 7 that are laid horizontally over the top of the structural unit, as discussed below. As shown in FIG. 3, the notches 4 permit the formation of berms 8.1 and 8.2 of different widths.

FIGS. 4 and 5 illustrate the two-shell structural system 1000, installed in an embankment. A layer of geosynthetics 7 is laid horizontally over the top of the two-shell structural unit. FIG. 4 shows the layer 7 applied between each stacked two-shell structural unit 100 and FIG. 5 shows the layer 7 applied only between selected layers. The geosynthetics 7 may be provided as a full-area layer or may be provided in the form of strips, depending on the requirements of the particular installation.

It is understood that the embodiments described herein are merely illustrative of the present invention. Variations in the construction of the two-shell structural unit and two-shell structural system may be contemplated by one skilled in the art without limiting the intended scope of the invention herein disclosed and as defined by the following claims.

What is claimed is:

1. A two-shell structural unit for forming an outer layer of a retaining system for a steep backfilled embankment, the two-shell structural unit comprising:

a front element constructed as a three-dimensional lattice structure;

a spacer element constructed to resist pressure from the steep backfilled embankment, the spacer element having a stepped form on a face that is an upper face when the two-shell structural unit is installed in the outer layer and having a mount on a lower end for securing the spacer element to the steep backfilled embankment;

a rear wall element that is formed of portions that are planar in shape, and that has a shape defined by a polygonal curve comprising straight line segments that extend upward when the rear-wall element is installed; and a plurality of connector pieces for fastening the front element and the rear-wall element to the spacer element;

wherein the front element is spaced a distance from the rear-wall element, thereby forming a cavity that is fillable with non-compacted soil.

2. The two-shell structural unit of claim 1, wherein the plurality of connector pieces provides positive and frictional joining of the front element and the rear-wall element to the spacer element.

3. The two-shell structural unit of claim 2, wherein individual ones of the plurality of connector pieces are provided at a top edge and a bottom edge of the spacer element.

4. The two-shell structural unit of claim 1, wherein the connector pieces are detachable.

5. The two-shell structural unit of claim 1, wherein the connector pieces are constructed as clips.

6. The two-shell structural unit of claim 1, wherein the front element, the spacer element, and the rear-wall element are constructed of synthetic material.

7. The two-shell structural unit of claim 1, wherein the front element, the spacer element, and the rear-wall element are constructed of geosynthetic material.

8. The two-shell structural unit of claim 7, wherein the geosynthetic material is a geogrid.

9. The two-shell structural unit of claim 1, wherein the lattice structure of the front wall element is an open structure.

10. The two-shell structural unit of claim 1, wherein the spacer element has an open lattice structure.

11. The two-shell structural unit of claim 1, wherein the rear wall element has an open lattice structure.

12. The two-shell structural unit claim 1, wherein the spacer has a rear face that connects with the rear wall element and a front face that connects with the front wall element, and wherein the stepped form on the upper face provides a series of successive notches, an overlying two-shell structural unit being supportable on the series of successive notches.

13. The two-shell structural unit of claim 1, wherein the mount includes a series of mounts that are fixed to a load-distributing rail.

14. A two-shell structural system for use as an outer layer for a retaining system for a steep backfilled embankment, the two-shell structural system comprising:

at least two two-shell structural units, each two-shell structural unit comprising a front element having a three-dimensional lattice structure; a spacer element constructed to resist pressure from the steep backfilled embankment, the spacer element having a stepped form on a face that is an upper face when the two-shell structural unit is installed in the outer layer and having a mount on a lower end for securing the spacer element to the steep backfilled embankment; a rear wall element that is formed of portions that are planar in shape, and that has a shape defined by a polygonal curve comprising straight line segments that extend upward when the two-shell structural unit is installed in the outer laver; and a plurality of connector pieces for fastening the front element and the rear-wall element to the spacer element; and wherein the front element is spaced a distance from the rear-wall element, thereby forming a cavity that is fillable with non-compacted soil; and a frictional joint for connecting two of the at least two-shell structural units, wherein the frictional joint is placed over a first two-shell structural unit and a second two-shell structural unit is placed over the frictional joint.

15. The two-shell structural system of claim 14, wherein the second two-shell structural unit is placeable over the first two-shell structural unit with the frictional joint so as to expose a selected portion of the stepped form on the first two-shell structural unit.

16. The two-shell structural system of claim 14, wherein, when three or more two-shell structural units are stacked, the frictional joint is placed between each pair of two adjoiningly stacked two-shell structural units.

17. The two-shell structural system of claim 16, wherein the frictional joint is placed selectively between any two adjoiningly stacked two-shell structural units.

* * * * *